United States Patent [19]

De brey

[11] 4,175,892

[45] * Nov. 27, 1979

[54] PARTICLE MONITOR

[76] Inventor: Robert J. De brey, 1830 E. 42nd St., Minneapolis, Minn. 55407

[ * ] Notice: The portion of the term of this patent subsequent to Jul. 4, 1989, has been disclaimed.

[21] Appl. No.: 939,384

[22] Filed: Sep. 5, 1978

Related U.S. Application Data

[63] Continuation of Ser. No. 487,676, Jul. 11, 1974, abandoned, which is a continuation of Ser. No. 252,323, May 10, 1972, abandoned, which is a continuation-in-part of Ser. No. 37,157, May 14, 1970, Pat. No. 3,674,316.

[51] Int. Cl.[2] ..... B65G 53/66

[52] U.S. Cl. ..... 406/35; 15/339

[58] Field of Search ..... 302/65; 15/339; 73/194 B

[56] References Cited

U.S. PATENT DOCUMENTS

| | | | |
|---|---|---|---|
| 964,800 | 7/1910 | Luden | 302/65 |
| 1,565,382 | 12/1925 | McClatchie | 116/67 |
| 1,633,598 | 6/1927 | McClatchie | 15/339 |
| 3,286,393 | 11/1966 | Ryan | 46/111 |
| 3,674,316 | 7/1972 | De brey | 302/65 |

OTHER PUBLICATIONS

"The Physics of Music", by Alexander Wood, Second Edition, 1944, pp. 149–150.

"Acoustics of Music", by Wilmer T. Bartholomew, 1942, pp. 129–131.

*Primary Examiner*—Jeffrey V. Nase

*Attorney, Agent, or Firm*—Burd, Braddock & Bartz

[57] ABSTRACT

A particle monitoring device located in a line carrying a moving fluid, as air, containing particles. The device has a particle sensing member providing audio signals that are in proportion to the amount of particles moving with the fluid. The sensing member is a flexible sheet member closing an open end of a connector housing having a chamber. Particles that hit the active section of the sheet member produce an audio signal providing information feedback of the amount of particles moving with the fluid.

19 Claims, 24 Drawing Figures

PARTICLE MONITOR

CROSS REFERENCE TO RELATED APPLICATION

This Application is a continuation of U.S. application Ser. No. 487,676, filed July 11, 1974, now abandoned. Application Ser. No. 487,676 is a continuation of U.S. application Ser. No. 252,323, filed May 10, 1972, now abandoned. Application Ser. No. 252,323 is a continuation-in-part of U.S. application Ser. No. 37,157, filed May 14, 1970, now U.S. Pat. No. 3,674,316.

BACKGROUND OF THE INVENTION

Particle monitoring devices using visual, audio, electronic parameters are used to detect particles in moving fluids. Vacuum cleaner lines have been provided with particle or dirt traps which function as settling chambers for receiving the relatively heavy particles moving in the air stream. An example of this vacuum cleaner trap is shown in U.S. Pat. No. 3,267,650. Some vacuum lines have been provided with settling chambers for observing and separating heavy objects from a moving air stream. An example of this structure is shown in U.S. Pat. No. 944,779. The use of a visual window, or other visual indicating means, for the purposes of monitoring the amount of particles in a moving air stream, has proven ineffective, as the window material, glass or other transparent medium becomes clouded. Efforts to overcome the inadequacies of the visual monitoring systems have been made by the use of a small circular rigid diaphragm, which will produce some audible sounds to provide an indication of dust or dirt in the air stream. An example of this structure is shown by McClatchie in U.S. Pat. No. 1,633,598.

Tests have shown that the McClatchie particle monitoring device operates at a resonant frequency that is substantially higher than the frequency of the highest human audio sensitivity. The McClatchie device peaks at 8 $KH^2$, has a relatively low sound output and is inoperative in slow moving air as it does not produce an audible output signal. The diaphragm of the McClatchie device collects dirt particles on the impaction surface fairly quickly. The accumulation of particles on the inside surface of the diaphragm dampens the sound output. In order to provide for an effective monitoring of the particles, the McClatchie diaphragm must be removed and cleaned as it does not have self-cleaning characteristics.

SUMMARY OF INVENTION

The invention relates to an active monitoring or sensing device operable to provide an information feedback which is in a direct and reliable relationship to the amount of particles moving with a fluid, as air. The sensing device has a particle sensing means located in an angular relationship with respect to the longitudinal axis of the flow of fluid carrying the particles. The sensing means has an inactive outer peripheral portion and an active flexible and deformable sheet member. This sheet member is sensitive to relatively small particles and relatively small quantities of particles. In use, the frequency of the ground signals emanating from the sheet member is at or close to the frequency at which the human ear is most sensitive. The flexible and deformable active sheet member in use has constant alternate or wave-like movements due to the impaction of particles on the inside surface. These movements provide the inside surface with self-cleaning characteristics so that the accumulation of particles on the sensing member will be at a minimum. In one form of the invention, the sensing means has a flexible and deformable active member positioned over the large end of a funnel-shaped housing. The particles moving in the air stream strike the active member thereby producing an audio signal. A protective screen can be used with the sensing means to prevent any damage to the active flexible sheet member. In a second form of the device, the sensing means is surrounded with an audio directing and focusing means. In another form of the device the sensing means is located in a pick-up nozzle of a vacuum cleaning apparatus.

IN THE DRAWINGS

Figure 1:
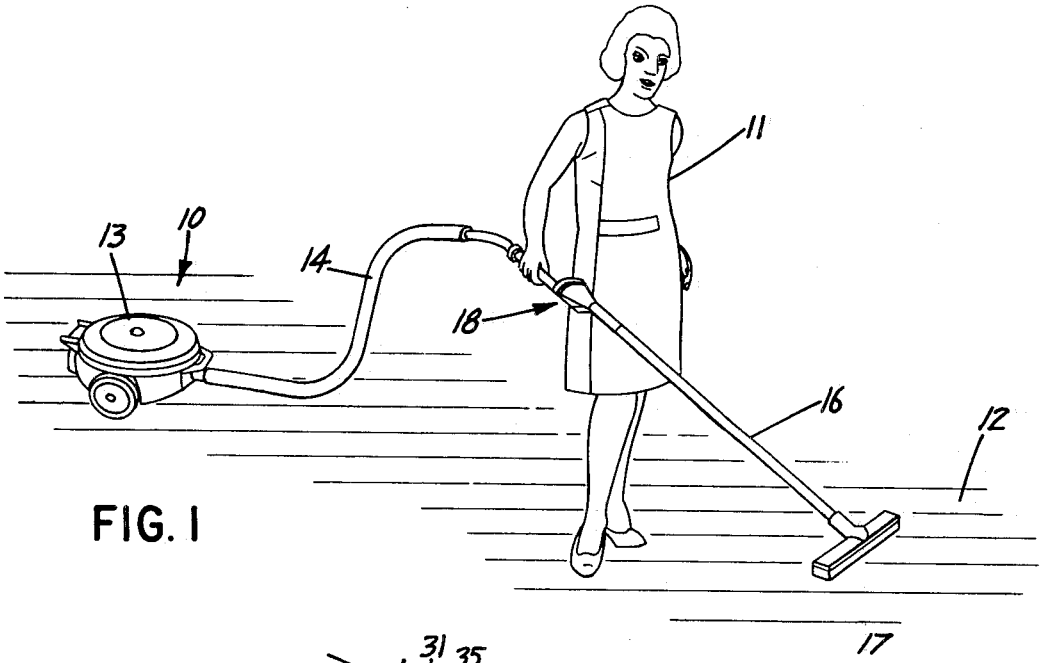
FIG. 1 is a side view of a canister vacuum cleaner equipped with the particle monitoring device of the invention.

Referring to the drawing, there is shown in FIG. 1 a vacuum cleaner, indicated generally at 10, being used by an operator 11, as a homemaker, for cleaning a floor or carpet 12. The cleaner 10 is a suction machine 13 having a motor, suction pump, and collection bag enclosed within a housing. Attached to the machine 13 is an elongated flexible hose 14 normally adapted to be connected to an elongated rigid tube 16 carrying a transverse nozzle or pick-up head 17. The upper end of the tube 16 is connected to the outer end of the hose 14 with the particle monitoring device of the invention, indicated generally at 18. The particle monitoring device is used to sense particles in the air moving through the device to provide the operator with information indicative of the amount of particles in the moving air. This information provides a direct and reliable relationship to the efficiency of the cleaning process. The operator will be able to determine when an area is clean and where extra cleaning attention is needed. The monitoring device 18 can be used with other types of vacuum cleaners, as well as other systems which use fluids to carry particles. The particle carrying fluid can be either a gas or liquid.

Figure 2:
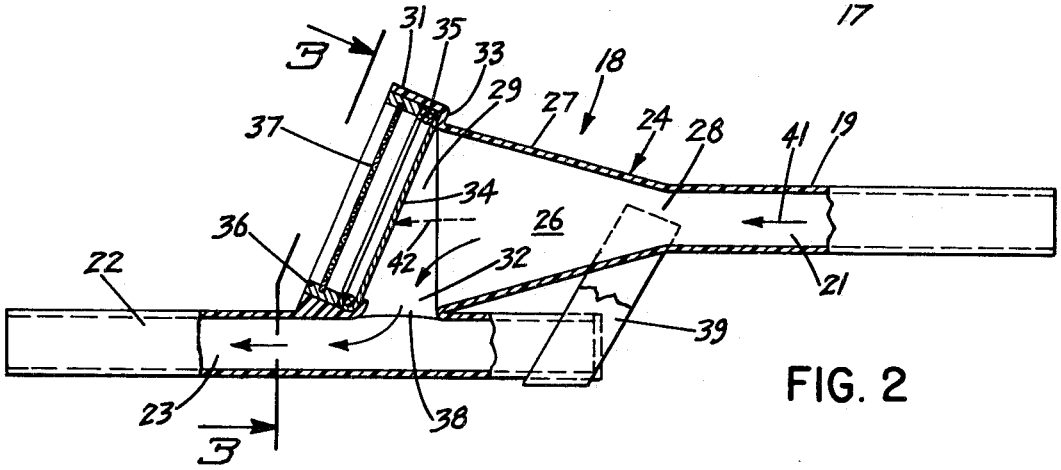
FIG. 2 is an enlarged side elevational view, partly sectioned, of the particle monitoring device of FIG. 1.
Figure 3:
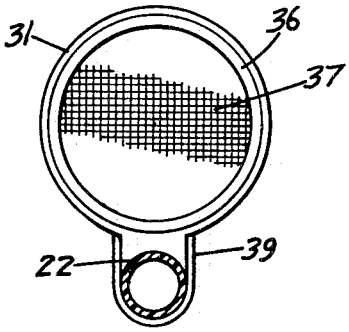
FIG. 3 is a plan view of the particle monitoring device facing the operator of the cleaner taken along line 3—3 of FIG. 2.

Referring to FIG. 2, the particle monitoring device 18 has an inlet tube 19 with a linear passage 21. Offset from the inlet tube 19 is an outlet tube 22 having a linear passage 23. The tubes 19 and 22 are connected to each other with a connecting assembly or housing, indicated generally at 24, having an enlarged cone-shaped expansion chamber 26 in communication with both passages 21 and 23. The cross sectional area of chamber 26 is substantially larger than the cross sectional area of the inlet opening 28. The ends of tubes 19 and 22 are of a size to fit with a telescope relation with the hose 14 and tube 16 so that the monitoring device 18 can be used with existing vacuum machines and can be detached for storage, cleaning and repair. The connecting assembly 24 has a funnel-shaped housing 27 having a small inlet and joined to the end of the tube 19 so that the inlet opening 28 of the chamber 26 is in axial alignment with the passage 21. The opposite end of the funnel-shaped housing 27 has a large open end 29. Preferably, the large open end 29 is about three times the diameter of the small inlet opening 28. Secured to the large end of the funnel housing 27 is a cylinder or sleeve 31 projected in an upward and outward direction. The axis of the cylinder 31 is between 20 and 30 degrees with respect to the horizontal axis of the housing 27. The space between the end of the housing 27 and the sleeve 31 is closed with a circular extension 32 so that the space between the funnel housing 27 and the sleeve 31 is part of the chamber 26.

The sleeve 31 has a diameter which is slightly larger than the diameter of the open end of the funnel housing 27 so that a small step or annular shoulder 33 joins the sleeve 31 to the housing 27 and extension 32. Extended across the base of the sleeve 31, in engagement with the shoulder 33, is a flexible circular cover or diaphragm 34. An annular expansion ring 35 holds the diaphragm in engagement with the sleeve 31. Other mechanical structure, as a large washer or clamp, can be used to hold the diaphragm on the sleeve 31. Only the peripheral edge of the diaphragm is held in engagement with the annular shoulder 33 so that the remainder of the diaphragm is free to vibrate and produce sound. The center of the diaphragm 34 is in alignment with the axial center line of the inlet passage 21. The center of diaphragm 34 can be below the center line of the inlet passage 21 so that the average particle impact point is at the approximate geometric center of the diaphragm.

The diaphragm 34 can be a relatively thin single sheet of plastic film, as Mylar film, having a 2 mil thickness. Other types of plastic sheets, as well as paper, metal foils and other materials of varying thickness, can be used as a diaphragm. The diaphragm can be laminated sheet material or sheet material reinforced with a woven wire plastic mesh. Preferably, the diaphragm should be made of material that is tough, flexible and has a high tear strength. The diaphragm is a sound producing membrane.

The diaphragm 34 is held in its position, in engagement with the shoulder 33, by a short sleeve or ring 36 located within the sleeve 31 with a light force fit. Extended across the sleeve 36 is a protective screen 37 to prevent outside objects from penetrating the diaphragm. The screen 37 may be made from fine wires or synthetic strands. For example, the screen may be a 12 mesh square pattern of stainless steel. This screen has an open area of approximately 52 percent to permit transmission of sound from the diaphragm 34 and chamber 26. The screen 27 is spaced a short distance from the diaphragm 34 so as not to interfere with the vibration and sound producing functions of the diaphragm. The screen 37 can be placed very close to the outside surface of the diaphragm 34 so that it can be used as a backup or reinforcing member for the diaphragm to help prevent puncturing of the diaphragm with outside objects. A second screen (not shown) can be located adjacent the inside or chamber side of the diaphragm to limit inward stretching of the diaphragm. Also, the diaphragm can carry the reinforcing screen between laminated sheet members. Other types of mechanical barriers can be used to reinforce the diaphragm.

The lower portion of the extension 32 has an exit opening 38 which provides communication between the passage 23 and the chamber 26. The exit opening 38 is located adjacent the large open end of the funnel housing 27 immediately below the angularly positioned diaphragm 34. The outlet tube 22 is secured to the extension 32 around the opening 38. A portion of the tube 22 extends below the funnel housing 27 and is attached to the housing 27 with an upwardly directed U-shaped member 39. The U-shaped member 39 surrounds the close end of the tube 22 so that the only fluid that flows through the tube 22 is withdrawn from the chamber 26.

The housing 47 can have other shapes, as semi-circular, square, rectangular, pyramid or elliptical. These housings are characterized as having side walls which increase in diameter as a function of distance from its inlet.

In use, the suction machine 13 establishes a vacuum force which draws air and dirt particles through the nozzle 17 along the tube 16 through the monitoring device 18 and into the machine 13 through the flexible hose 14. As the air and entrained particles, indicated at arrow 41 in FIG. 2, enter the monitoring device 18, they are directed into the expansion chamber 26 of the funnel housing 27 in an axial direction. The air flows directly at the diaphragm 34. In the chamber 26, the velocity of the air decreases and the air changes direction toward the outlet opening 38 for movement into the passage 23. The heavier particles having momentum impinge against or hit the central portion of the diaphragm 34 causing the diaphragm to vibrate. In addition, the particles, as they impinge on the diaphragm, create sounds which are projected outwardly toward the ear of the operator 11. The low velocity air flow in chamber 26 improves the chances of the particles hitting the diaphragm 34 because the particles are not immediately carried away by the moving air. The funnel shape of the housing 27 concentrates the sound waves and thereby increases their audio characteristics. In this manner, even relatively small particles can be detected by the human ear. After the impact of the particles, indicated by broken line arrows 42 on the diaphragm 34, they proceed downwardly with the air stream through the exit opening 38 into the outlet passage 23 and into the flexible hose 14. The inclined or angular position of the diaphragm 34 insures that all of the particles are drawn out of the expansion chamber 26 so that they do not recirculate and cause multiple impactions and false information of the amount of particles moving with the air.

The flow rate of the air through the particle monitoring device varies with the area of the various portions of the device. As the velocity of the air decreases in the expansion chamber 26, there is an increase in the pressure of the air in the chamber. The highest pressure would be just in front of the diaphragm 34. This reduces the stretching tension on the diaphragm 34 created by the vaccum pressure inside the system. Accordingly, a thinner and more sensitive diaphragm material can be employed and thereby increase the sensitivity of the sensing device.

The monitoring device 18 provides the operator 11 of the vaccum cleaner with audio information that is directly related to the number of particles striking the diaphragm 34. Thus, the operator has a direct and reliable relationship as to the operating efficiency of the cleaner or the effectiveness of the cleaning operation. This information will enable the operator to be able to determine when an area is clean and if extra cleaning attention is needed. In addition, the operator will have the psychological reward that the cleaning efforts are effective. In industrial or laboratory uses, the particle monitoring device can be used to insure and inspect the cleanliness of a cleaned area, thereby determining the operating efficiency of other cleaning equipment that is used to produce clean environments.

Figure 4:
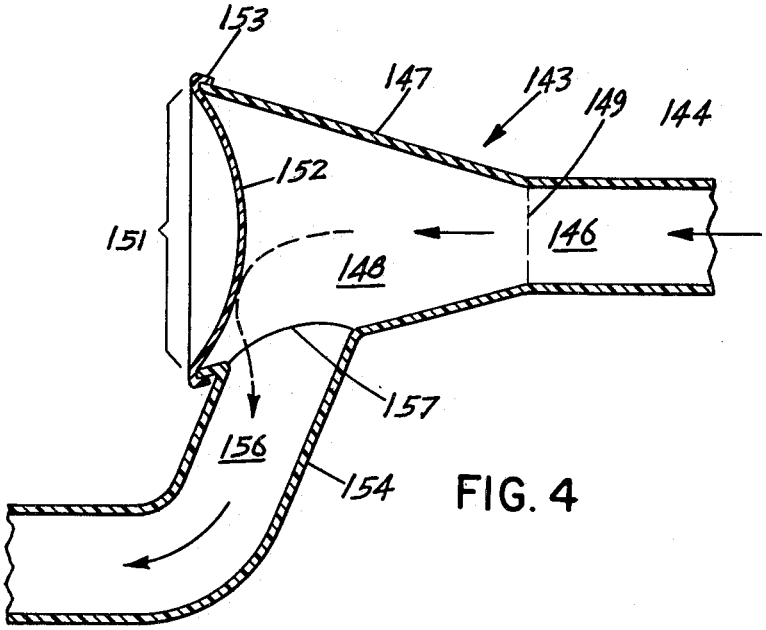
FIG. 4 is a diagrammatic view of another particle monitoring apparatus of the invention.
Figure 5:
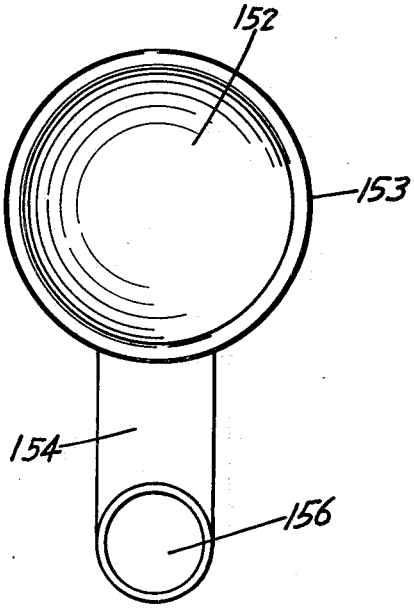
FIG. 5 is a front elevational view of the particle monitoring apparatus of FIG. 4.

Referring to FIGS. 4 and 5, there is shown a modified particle monitoring device, indicated generally at 143, for sensing particles in a moving fluid, as air. The device 143 has an inlet tube 144 having a passage 146 for carrying the fluid and entrained particles from a source. The tube 144 is connected to the inlet end of a funnel-shaped housing 147 having a cone-shaped transitional expansion chamber 148. The expansion chamber has an inlet opening 149 in axial alignment with the inlet passage 146 and a large outer circular end 151. A cover or diaphragm 152 of sound producing material, as plastic, sheet metal or the like, fits on the outer end of the funnel-shaped housing 147. The peripheral portion of the cover has a generally U-shaped annular lip 153 which clamps onto the end of the housing. Other structures can be used to attach the cover 152 to the housing 147. The cover 153 has a slight concave shape which projects into the expansion chamber 148. The axis of the concave curvature of the cover 152 is in generally axial alignment with the longitudinal axis of the chamber 143. Secured to the lower portion of the housing 147 is an angularly positioned outlet tube 154 having a passage 156 leading to the source of vacuum pressure. The exit opening 157, adjacent the inside of the cover 152, opens to the passage 156 so that the air can flow from the expansion chamber 148 through the exit passage 156. Opening 157 is directly below the concave cover 152 so that the particles that hit the cover 152 will move from the chamber 148 to the outlet passage 156.

In use, the expansion chamber 148, having a cross sectional area larger than the cross sectional area of the passage 146 and exit passage 156, causes a reduction in the velocity of the movement of the air through the chamber 148 and an increase in the pressure of the air in the chamber 148. The decrease in the velocity of the air insures that substantially all of the particles entrained in the air will strike the cover 152 with sufficient force to produce an audible signal.

Figure 6:
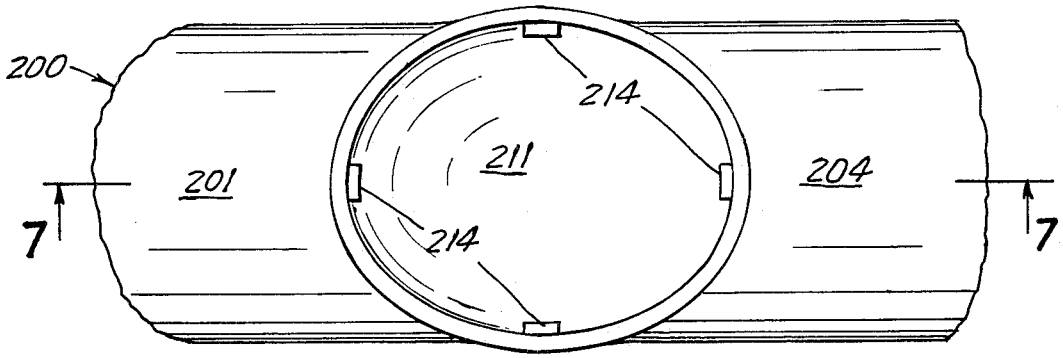
FIG. 6 is a top plan view of a further modification of the particle monitor of the invention.
Figure 7:
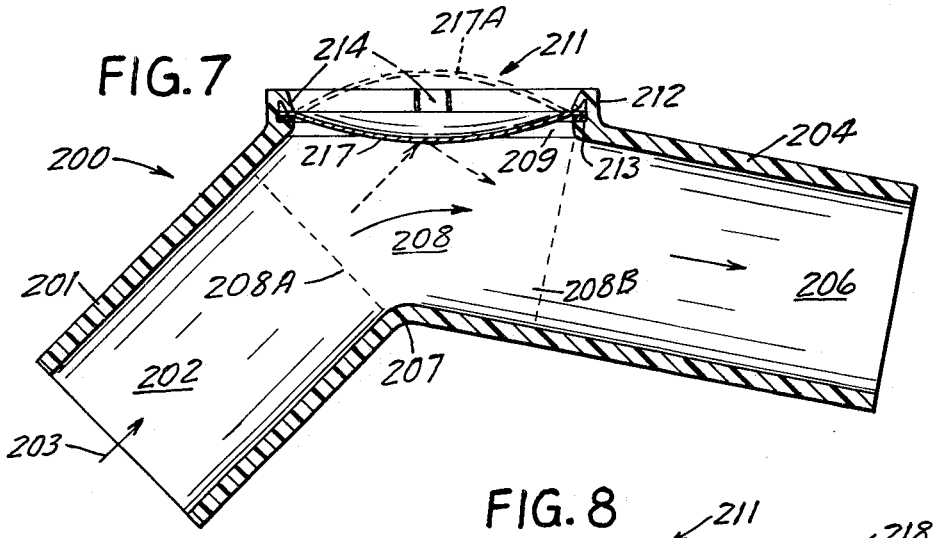
FIG. 7 is a sectional view taken along the line 7—7 of FIG. 6.

Referring to FIGS. 6 and 7, there is shown a further modification of the particle monitoring device of the invention, indicated generally at 200, for sensing particles in a flowing fluid, as air. The particle monitoring device 200 has an inlet tubular member 201 defining an inlet passage 202 for carrying fluid and particles, indicated by the arrow 203. An outlet tubular member 204, having an outlet passage 206, is angularly disposed relative to the inlet tubular member 201. The inlet tubular member 201 and outlet tubular member 204 are joined together with a connector housing 207 having a chamber 208. Chamber 208 has an inlet 208A open to passage 202 and an outlet 208B open to passage 206. The upper part of the connector housing 207 has an opening 209 exposing a substantial portion of the chamber 208. The opening 209 has a cross sectional area that is larger than the cross sectional area of the inlet passage 203. This can be achieved by cutting the end of tubular member 201 at an angle. The opening 209 has a generally elliptical shape and is inclined in a forward and downward direction with respect to the longitudinal axis of the passage 202. The transverse plane of opening 209 is at an angle with respect to the longitudinal axis of passage 202 and the center of opening 209 generally coincides or is aligned with the longitudinal axis of passage 202.

The opening 209 is closed with a particle sensing means indicated generally at 211. The sensing means 211 is located within a flange or lip 212 on the connector housing 207. The bottom portion of the lip 212 has an inwardly directed shoulder 213 engageable with the outer peripheral edge of the particle sensing means 211. A plurality of inwardly directed fingers 214 retain the particle sensing means in assembled relation with the connector 207.

Figure 8:
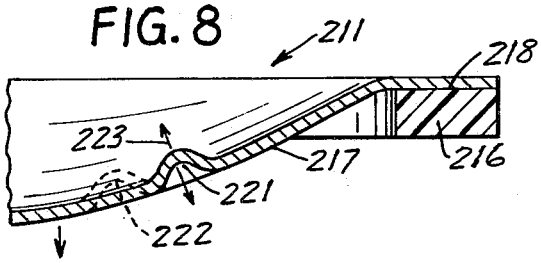
FIG. 8 is an enlarged sectional view of the particle sensing means shown in FIGS. 6 and 7.

Particle sensing means 211 has an annular outer peripheral member 216. The member 216 is an inactive self-supporting structure connected to an active flexible sheet member 217. As shown in FIG. 8, the outer peripheral edge of the sheet member 217 is joined with an adhesive or suitable bonding material 218 to the top surface of the annular peripheral member 216. The sheet member 217 is a deformable, flexible sound-producing member, as metal foil, plastic, and the like. The sheet member 217 does not have sufficient structural rigidity to hold itself in a generally flat plane. When the chamber 208 is subjected to a vacuum force, the sheet member 217 will move to a concave position, as shown in FIGS. 7 and 8, thereby placing the sheet member 217 under tension. The entire thickness of the sheet member is under tension. Both the inner surface and the outer surface of the sheet member are in a state of tension. In a pressurized system the active sheet member will also be under tension and assume a convex or dome shape, as shown by sheet member 217A in broken lines in FIG. 7.

The outer peripheral edge of the sheet member 217 may be clamped on or restrained on the member 216, a separate annular seal or an annular portion or shoulder of the connecting means with any suitable means as a ring clamp, taper clamp, or the like. The outer peripheral edge of sheet member 217 may be enlarged, rolled or otherwise formed to increase its strength. Suitable holding means, as the aforesaid clamps, may be used to restrain a sheet member on the housing.

The air moving through the inlet passage 202 moves the particles toward the active sheet member 217. As shown by the broken line arrow 219, the particles will continue to move in a generally linear direction until they strike the sheet member 217 while the air moves through the chamber 218 to the outlet passage 206. The impingement of the particles on the active sheet member 217 will produce audio signals which can be sensed by the operator of the device. Sheet member 217 is sensitive to relatively small particles and relatively small quantities of particles in the flowing fluid. Also, the frequency of the sound signal emanating from the sheet member is at or close to the frequency at which the human ear is most sensitive.

The active sheet member 217 is initially deformed and placed under tension when it is subjected to either a vacuum or pressure force. Secondary deformation of the sheet member is caused by impaction of particles on the sheet member. This deformation may be permanent, semi-permanent or temporary.

Referring to FIG. 8, when a particle possessing sufficient energy strikes the sheet member 217 it will impart therein a recess 221 as the sheet member does not have sufficient rigidity or strength to resist the impact force of the particle. When a subsequent particle strikes the sheet member 217 adjacent the recess 221, a second recess 222 will be formed in the sheet member. The deformed material constituting first recess 221 will revert to its original shape as shown in broken lines or to a new shape. The particles continuously strike the sheet member 217 so that the small portions of the sheet member will repetitively move in opposite directions, as indicated by the arrow 223. This will cause small wave-like motions in the sheet member whereby any accumulation of particles are thereby eliminated. This motion inhibits the accumulation of particles on the inner surface of the sheet member. Also, any accumulation of particles on the inner surface will flake off and be carried away from the sensing means by the moving fluid so that the sheet member is self-cleaning.

Figure 9:
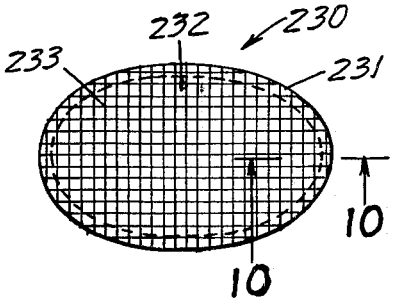
FIG. 9 is a top plan view of a modified particle sensing means usable with the monitor shown in FIGS. 6 and 7.
Figure 10:
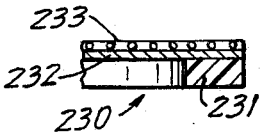
FIG. 10 is an enlarged sectional view taken along the line 10—10 of FIG. 9.

Referring to FIGS. 9 to 12, there is shown a modification of the structure of the particle sensing means. A particle sensing means 230, as shown in FIGS. 9 and 10, has an annular inactive peripheral member 231 adapted to be mounted on a housing. Secured to the member 231 is an active flexible sheet member 232. An open mechanical barrier, as a screen 233, is located adjacent the top of the active sheet member 232. The barrier 233 is only attached at its outer peripheral portions to the inactive edge portion of the sheet member 232, whereby the sheet member 232 is free to flex and move relative to the barrier.

Figure 11:
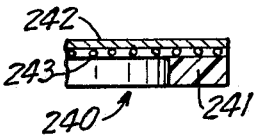
FIG. 11 is a sectional view similar to FIG. 10 showing a modification of the structure of the sensing means.

A particle sensing unit 240, shown in FIG. 11, has an annular peripheral member 241 carrying an active sheet member 242. An open mechanical barrier has a screen 243 located adjacent the inner or lower side of the sheet member 242. The mechanical barrier 243 will hold portions of the sheet member. Portions of the sheet member between the wires may flex or deform inwardly when the sheet member is subjected to a vacuum force. Impaction of particles on the sheet member may deform the sheet member to assume an outwardly curved shape.

Figure 12:
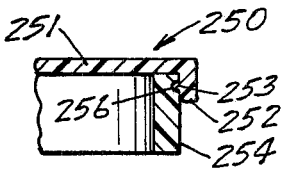
FIG. 12 is a fragmentary sectional view of a further modification of the sensing means mounted on a portion of the housing of the monitor.

FIG. 12 shows another particle sensing means, indicated generally at 250. The sensing means 250 has an active flexible sheet member 251 integrally joined to an outer peripheral inactive section 252. Section 252 is normally disposed with respect to the sheet member 251 and has an inwardly annular bead 253. Section 252 can have a greater cross sectional area than the sheet member so that it has sufficient strength to maintain the particle sensing means on a rib or flange 254. The outer portion of the flange 254 has a groove 256 to accommodate the bead 253. The bead and groove provide the particle sensing unit with a snap-on attachment so that it can be readily removed for cleaning and maintenance or replacement.

Figure 13:
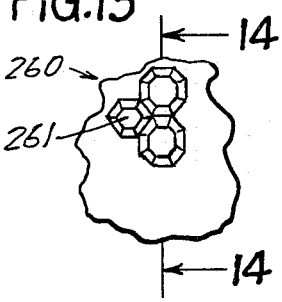
FIG. 13 is a partial fragmentary plan view of a modification of the flexible active member of the sensing means.
Figure 14:
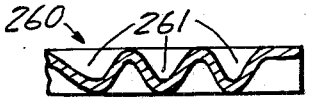
FIG. 14 is an enlarged sectional view taken along line 14—14 of FIG. 13.

Referring to FIGS. 13 and 14, there is shown a modification of the structure of the active sheet member, indicated generally at 260. The active sheet member 260 is a relatively thin flexible and deformable member, preferably of sheet metal, as aluminum foil, tin foil, and the like. The surface of the sheet member 260 has a plurality of side by side cavities or depressions 261. Each depression 261 has a generally hexagonal shape and converges inwardly whereby the bottom of each cavity is substantially smaller than its top or open portion of the cavity. The cavities can have other shapes as hemispherical, square, octagonal, and the like. The active sheet members can be made of fabric, plastic, or rubber having coatings. The coatings can be plastic materials, as silicone or Teflon, that inhibit sticking of particles on the sound generating surface. The active portion of the sheet member can be pretensioned on an open frame or ring support, as ring 216 shown in FIG. 8. The sheet material can be stretched and bonded to the ring support in its stretched condition. Alternatively, the sheet material can be stretched to fit over a ring support or the lip 212 of connector housing 207, as shown by annular lip 153 in FIG. 4.

Figure 16:
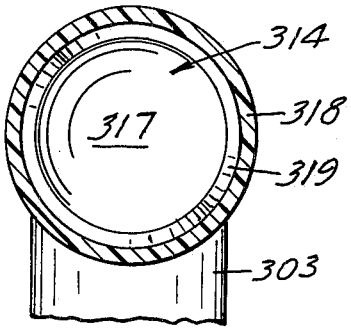
FIG. 16 is a sectional view taken along the line 16—16 of FIG. 15.
Figure 15:
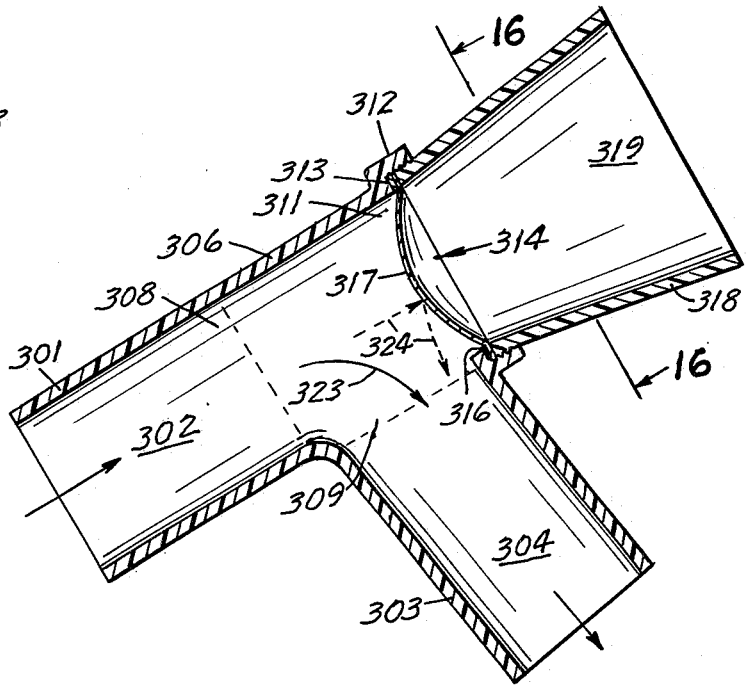
FIG. 15 is a longitudinal sectional view of a still further modification of the invention.
Figure 17:
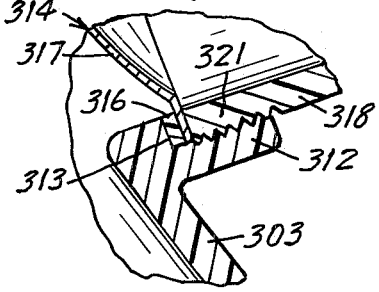
FIG. 17 is an enlarged sectional view showing the attachment of the focusing sleeve to the housing.

Referring to FIGS. 15 to 17, there is shown a further modification of the particle monitor, indicated generally at 300. Monitor 300 has a tubular inlet member 301 defining an inlet passage 302. Angularly located relative to the member 301 is a tubular outlet member 303 defining an outlet passage 304. A connector housing 306 joins tubular members 301 and 303. The housing 306 has a chamber 307 in communication with passages 302 and 304. Chamber 307 has an inlet 308 and an outlet 309 whereby the fluid, as air, can flow through the monitor. Housing 306 has an opening 311 located across the end in general axial alignment with the longitudinal axis of inlet passage 302. A circular flange 312 surrounds the opening 311. The flange has an inwardly directed annular shoulder 313 for supporting a particle sensing means, indicated generally at 314. The particle sensing means 314 functions to produce an audible sound when hit by a solid particle, such as dust or dirt particles that are carried by the fluid moving through the chamber 307. The particle sensing means has an outer inactive peripheral edge portion 316. Portion 316 is relatively rigid and is a non-active section of the particle sensing means. Secured to portion 316 is the active flexible sheet member 317. As shown in FIG. 17, when the chamber 307 is subjected to a vacuum pressure, the flexible sheet member will be placed in tension and deform into a concave shape.

The particle sensing means 314 is retained on the housing 306 with an extension sleeve 318 having an outward diverging taper and forming a passageway 319. As shown in FIG. 17, the inner end 321 of sleeve 318 is threadably engaged with flange 312 to thereby mount the sleeve on the housing 306. The bottom surface 322 of the end 321 engages the top of the outer peripheral portion of the particle sensing means to clamp the peripheral edge portion 316 into engagement with shoulder 313.

In use, the air flows through the monitor, as indicated by arrows 323. As the air changes direction in the chamber 307, the momentum of the particles will carry the particles into engagement with the flexible active sheet member 317, as shown by broken line arrow 324. On impact of the particle on the active sheet member 31, an audible sound is established. The sound signal is focused by the passageway 319 of the sleeve 318 and directed thereby in a selected direction, as toward the operator of the monitor.

Figure 19:
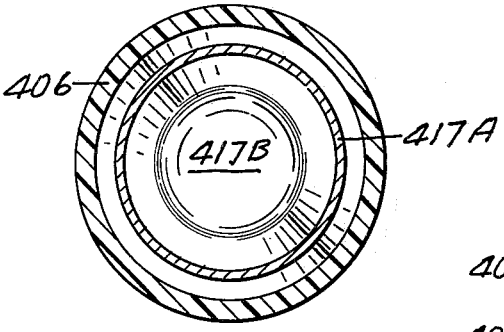
FIG. 19 is a sectional view taken along the line 19—19 of FIG. 18.
Figure 18:
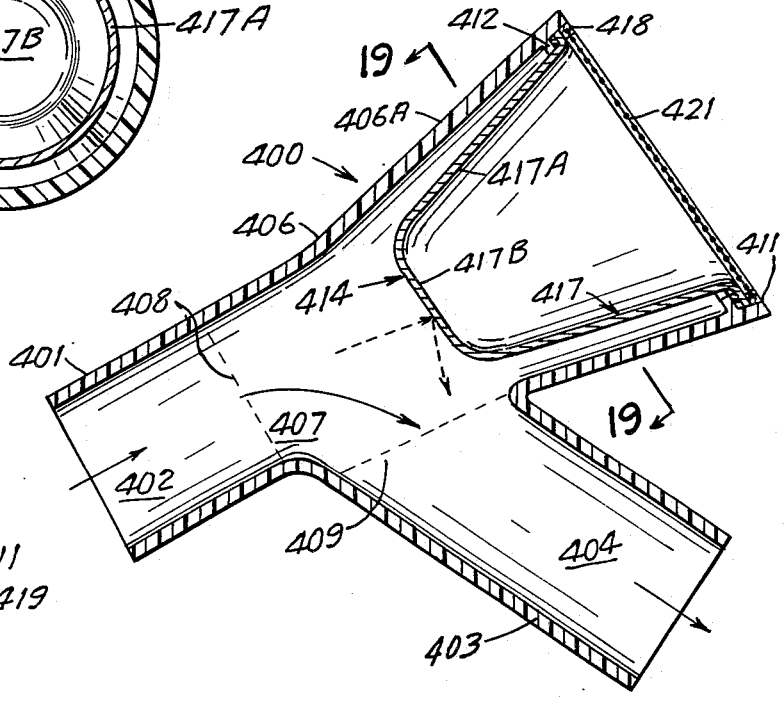
FIG. 18 is a longitudinal sectional view of another modification of the particle monitor of the invention.
Figure 20:
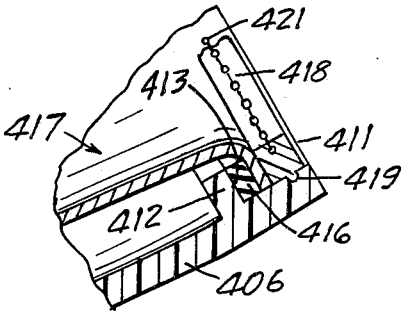
FIG. 20 is an enlarged sectional view showing the structure mounting the particle sensing means to the housing.

Referring to FIGS. 18 to 20, there is shown a further modification of the particle monitor, indicated generally at 400. Monitor 400 has an inlet tubular member 401 defining passageway 402. Angularly disposed with member 401 is an outlet tubular member 403 defining an outlet passage 404. A connector housing 406 joins members 401 and 403. Housing 406 has a chamber 407 having an inlet 408 in communication with the passage 402 and an outlet 409 in communication with passage 404, whereby the air and particles entrained in the air can flow through the monitor, as indicated by the arrows. Housing 406 has an outwardly diverging sleeve or extension 406A having a large open end 411. Spaced a short distance inwardly from the end 411 is an inwardly directed annular flange 412 having an outer shoulder or face 413.

A particle sensing means 414 is mounted on the flange 412 and extends into the space defined by the sleeve 406A. The sensing means 414 has an annular outer peripheral inactive portion 416 secured to a flexible active sheet member 417. Sheet member 417 has a tapering sleeve side wall 417A and a concave shaped bottom wall 417B. The general shape of the flexible active sheet member is a cup shape with a bottom wall 417B in communication with the chamber 407 and in general axial alignment with the passage 402. As shown in FIG. 20, a ring 418 fits into the upper portion of sleeve 406A to hold the particle sensing means in engagement with the shoulder 413 of flange 412. The ring 418 has an outer annular rib 419 that fits into a suitable groove in the inside of sleeve 406A to maintain the ring in assembled relation with the sleeve 406A. Other coacting structures can be used to hold ring 414 on the sleeve 406A. The ring 418 carries an open mechanical barrier 421, as an open mesh screen, to prevent damage to the flexible active sheet member 417. In use, the particles that strike the end wall 417B will establish a sound signal that is focused by the shape of the side walls 417A of the particle sensing means and directed outwardly through mechanical barrier 421 toward the operator.

Figure 21:
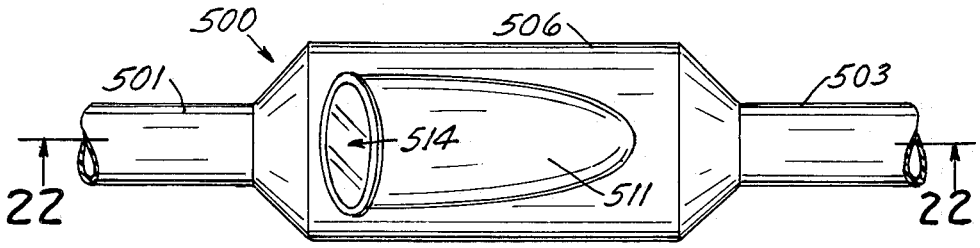
FIG. 21 is a top plan view of another modification of the particle monitor of the invention.
Figure 22:
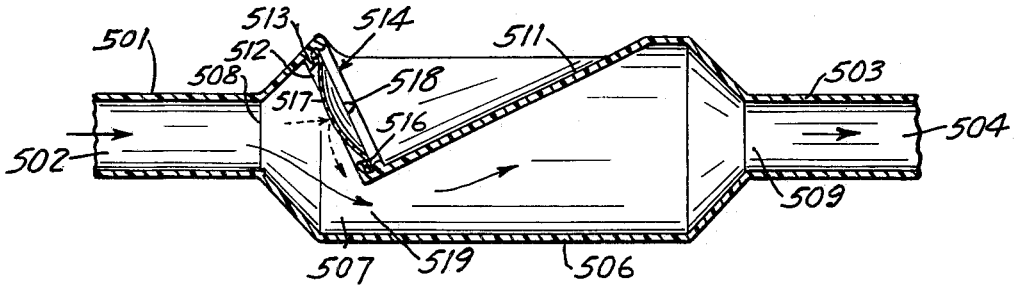
FIG. 22 is a sectional view taken along the line 22—22 of FIG. 21.

Referring to FIGS. 21 and 22, there is shown still another modification of the particle monitor indicated generally at 500. Monitor 500 has an inlet tubular member 501 defining an inlet passage 502. Longitudinally spaced from inlet member 501 is an outlet tubular member 503 having an outlet passage 504. A connector housing 506 is connected at its opposite ends to inlet member 501 and outlet member 503. Housing 506 has a chamber 507 having an inlet 508 in communication with passage 502 and an outlet 509 in communication with passage 504 whereby the air and particles flow through monitor 500. Passages 502 and 504 and chamber 507 are in axial alignment. As shown in FIG. 22, housing 506 has a downwardly and forwardly extended wall 511 having an opening 512 in the forward end thereof. The wall 511 has an arcuate shape defining a space that is open to the top of the housing. The opening 512 is surrounded by inwardly directed annular flange 513 carrying a particle sensing means, indicated generally at 514. The particle sensing means closes the opening 512 and has an inactive outer peripheral member 516 mounted on flange 513. Secured to member 516 is a flexible active sheet member 517 which assumes a concave shape in response to a vacuum force in the chamber 507. The wall 511 has a plurality of spaced ears or abutments 518 which hold the particle sensing means in assembled relation with flange 513.

The particle sensing means 514 is located in general axial alignment with the axis of passage 502 with the center portion located generally along the central axis of passage 502. The sensing means 514 is inclined downwardly and inwardly, directing the air and particles toward the throat or opening 519 adjacent the lowest portion of wall 511. The particle sensing means 514 establishes sound upon impact of particles on the flexible active sheet member 517. The sound signal is focused and directed by wall 511 toward the operator or in a generally upward and rearward direction.

Figure 23:
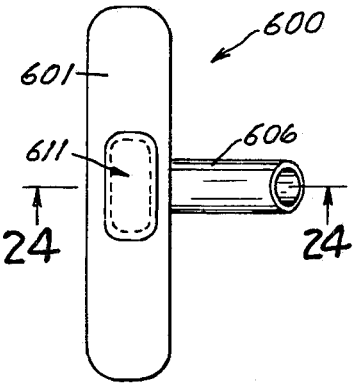
FIG. 23 is a top plan view of a pick-up nozzle for a vacuum cleaner apparatus equipped with the particle sensing means of the invention.
Figure 24:
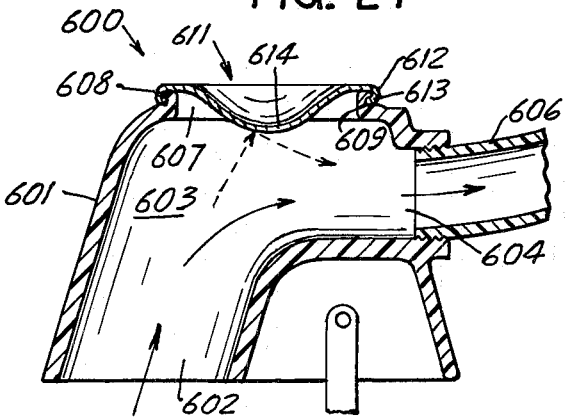
FIG. 24 is an enlarged sectional view taken along the line 24—24 of FIG. 23.

Referring to FIGS. 23 and 24, there is shown a pick-up nozzle, indicated generally at 600 for a vacuum cleaner apparatus. Nozzle 600 has an elongated housing 601. As shown in FIG. 24, the bottom of the housing has an elongated inlet 602 open to an internal chamber 603. Housing 601 has an outlet 604 at the back side thereof whereby the air and particles will flow through the chamber 603 into an outlet tube 606, such as the conventional tubular handle of a vacuum cleaner.

The top of housing 601 has an elongated central opening 607. Housing 601 has a generally upright rib 608 surrounding the opening 607. The outer portion of rib 608 has a groove 609. The opening 607, shown in FIG. 23, is an elongated shape aligned with the tube 606. The opening is closed with a particle sensing means indicated generally at 611. The particle sensing means 611 as an outer peripheral flange or ring 612 having an inwardly directed bead 613 positioned in groove 609 to hold the particle sensing means 611 in assembled relation with rib 608. Integrally joined to ring 612 is a flexible active sheet member 614. As shown in FIG. 24, the sheet member 614 assumes a generally concave configuration when subjected to a vacuum force in chamber 603. The particles picked up by the nozzle move through chamber 603. The particles, because of their momentum, will continue to move in an upward direction and strike the active sheet member 614 and thereby produce an audible signal which is detectable by the operator of the apparatus. The particle sensing means can have a circular, square, rectangular or other configuration. Also, other types of structures can be used to attach the particle sensing means to housing 601.

The embodiments of the invention in which an exclusive property or privilege is claimed are defined as follows:

1. An apparatus for sensing particles in a flowing fluid comprising: first means having a first passage for carrying fluid; second means having a second passage for carrying fluid; connecting means joining the first means with the second means, said connecting means having an inside wall surrounding a chamber, an inlet opening in communication with the first passage, said chamber of said connecting means increasing in transverse cross section has a function of distance away from the inlet opening, an open portion located in general longitudinal alignment with the inlet opening, said open portions being larger than the inlet opening and located at the large end of said chamber, and an outlet opening in communication with the second passage; said second means adapted to be coupled to means for applying a vacuum force whereby fluid and particles flow from the first passage through said chamber to the second passage; particle sensing means closing the open portion providing a deformable barrier means for particles moving through said chamber, said sensing means including an active flexible and deformable sheet member having an outer peripheral portion and a size larger than the inlet opening; means cooperating with said outer peripheral portion to mount said sheet member on said connecting means, said sheet member being placed under tension by the vacuum force applied to the chamber and being located in non-parallel relationship with respect to the longitudinal axis of the first passage so that portions of the sheet member are hit by particles moving with fluid flowing through said chamber, said sheet member having a thickness and flexibility so that said portions are repetitively moved outwardly by the moving particles that hit the sheet member and inwardly by the vacuum force whereby said portions of the sheet member have repetitive wave-like movements which inhibit collection of particles on the sheet member, said particles when striking the sheet member creating a readable sound signal related to the amount of moving particles which strike the sheet member, said active flexible sheet member having a generally cup-shaped configuration extended into said chamber whereby the flexible sheet member focuses the audible signals emanating therefrom.

2. The apparatus of claim 1 wherein: the first means and second means are tubes, and said connecting means comprises a housing connected to the tubes.

3. The apparatus of claim 1 wherein: the outlet opening is located adjacent a part of the outer peripheral portion of the sheet member.

4. The apparatus of claim 1 including: mechanical barrier means mounted on the connecting means and located over the open portion adjacent the outside of the sheet member.

5. The apparatus of claim 1 wherein: the means cooperating with said outer peripheral portion to mount the sheet member on said connecting means comprises ring means releasably mounted on the connecting means.

6. The apparatus of claim 5 including: mechanical barrier means mounted on the ring means, said barrier means being located over the open portion adjacent the outside of the sheet member.

7. The apparatus of claim 1 including: sleeve means attached to the connecting means in general axial alignment with the sheet member.

8. The apparatus of claim 7 wherein: the sleeve means is an annular outwardly projected tubular member.

9. An apparatus for sensing particles in a flowing fluid comprising: first means having a first passage for carrying fluid, second means having a second passage for carrying fluid, connecting means joining the first means with the second means, said first means extended toward the connecting means and said second means extended away from the connecting means, said connecting means comprising a housing having an inside wall surrounding a large chamber open to the first passage and an outlet opening open to the second passage, said housing having an inlet opening in communication with the first passage and an open end generally aligned with the inlet opening, said open end being substantially larger than the inlet opening, said chamber generally increasing in cross section as a function of distance away from the inlet opening toward the open end, particle sensing means mounted on said housing and located across the open end of said housing opposite the inlet opening adjacent the outlet opening and inclined with respect to the longitudinal axis of the first passage, said sensing means comprising a flexible sheet member located across the open end of the housing, said sheet member having an outer peripheral portion and a portion extendible in a concave shape into the chamber to provide a barrier for particles moving with the fluid flowing through said chamber whereby when said particles strike said sheet member a readable sound signal related to the flow of particles through the chamber is established, means mounting only said outer peripheral portion of the sheet member on said housing, said second means adapted to be coupled to means for applying a vacuum force whereby fluid and particles flow from the first passage through said chamber to the second passage, said sheet member being placed under tension by vacuum force applied to the chamber, said sheet member having a thickness and flexibility so that portions of the sheet member that are hit by particles moving with the fluid flowing through the chamber are repetitively moved outwardly by the moving particles and moved inwardly by the vacuum force, whereby said portions of the sheet member have repetitive wave-like movements which inhibit collection of particles on the sheet member.

10. The apparatus of claim 9 wherein: the housing has a generally funnel-shaped chamber.

11. The apparatus of claim 9 wherein: the center portion of the sheet member is in general axial alignment with the longitudinal axis of the first passage.

12. The apparatus of claim 9 including: mechanical barrier means located adjacent to the sheet member.

13. The apparatus of claim 9 including: sleeve means attached to the connecting means in general axial alignment with the sheet member for focusing the audible signals emanating from the sheet member.

14. The apparatus of claim 13 wherein: sleeve means is an annular outwardly projected tubular member.

15. The apparatus of claim 13 wherein: the sleeve means has a portion attachable to said connecting means, said portion of the sleeve means holding the sheet member on said connecting means.

16. The apparatus of claim 9 wherein: said second passage is offset from the first passage.

17. The apparatus of claim 9 wherein: said second passage has a portion thereof in substantial parallel alignment with the first passage.

18. The apparatus of claim 9 wherein: the outlet opening is located adjacent the open end.

19. The apparatus of claim 9 wherein: the first means is located in general parallel alignment with the second means.

* * * * *

UNITED STATES PATENT AND TRADEMARK OFFICE

CERTIFICATE OF CORRECTION

PATENT NO. : 4,175,892

DATED : November 27, 1979

INVENTOR(S) : Robert J. De brey

It is certified that error appears in the above-identified patent and that said Letters Patent are hereby corrected as shown below:

Column 1, line 63, "ground" should be --sound--.

Column 4, line 28, "27" should be --37--.

Column 4, line 51, "close" should be --closed--.

Column 5, line 68, "143" should be --148--.

Column 9, line 1, "FIG. 17" should be --FIG. 15--.

Column 9, line 20, "31" should be --317--.

Column 10, line 51, "as" should be --has--.

Signed and Sealed this

*Twenty-fifth* Day of *March 1980*

[SEAL]

*Attest:*

SIDNEY A. DIAMOND

*Attesting Officer*

*Commissioner of Patents and Trademarks*